US011688346B2

(12) United States Patent
Wang et al.

(10) Patent No.: US 11,688,346 B2
(45) Date of Patent: Jun. 27, 2023

(54) ACTIVE OPTICAL COMPONENT LIGHT EMISSION CONTROL METHOD

(71) Applicant: Huawei Technologies Co., Ltd., Shenzhen (CN)

(72) Inventors: Minchang Wang, Shenzhen (CN); Hui Meng, Xi'an (CN); Xinyu Zhao, Dongguan (CN); Jun Tao, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/481,797

(22) Filed: Sep. 22, 2021

(65) Prior Publication Data

US 2022/0005416 A1 Jan. 6, 2022

Related U.S. Application Data

(63) Continuation of application No. PCT/CN2020/079801, filed on Mar. 18, 2020.

(30) Foreign Application Priority Data

Mar. 22, 2019 (CN) ..... 201910223114.5

(51) Int. Cl.
*G09G 3/3258* (2016.01)

(52) U.S. Cl.
CPC ..... *G09G 3/3258* (2013.01); *G09G 2310/061* (2013.01); *G09G 2370/18* (2013.01)

(58) Field of Classification Search
CPC ..... G09G 3/3258
See application file for complete search history.

(56) References Cited

U.S. PATENT DOCUMENTS

| | | | |
|---|---|---|---|
| 2019/0057642 | A1 | 2/2019 | Kim et al. |
| 2020/0117782 | A1 | 4/2020 | Lee et al. |

FOREIGN PATENT DOCUMENTS

| | | | |
|---|---|---|---|
| CN | 107911554 | A | 4/2018 |
| CN | 107979698 | A | 5/2018 |
| CN | 108540594 | A | 9/2018 |
| CN | 108769358 | A | 11/2018 |
| EP | 3291217 | A1 | 3/2018 |
| WO | 2018186580 | A1 | 10/2018 |

*Primary Examiner* — Gustavo Polo
(74) *Attorney, Agent, or Firm* — Conley Rose, P.C.

(57) ABSTRACT

An electronic device includes a display screen, a display control circuit, an active optical component, and an optical control circuit. The active optical component is located below the display screen. The display control circuit is configured to control refreshing of the display screen, and output a synchronization signal to the optical control circuit. The optical control circuit is configured to receive the synchronization signal, and control the active optical component to start light emission after a predetermined first delay that is after a moment corresponding to the synchronization signal to enable the display control circuit to refresh to one row of at least one row on the display screen corresponding to the active optical component after a predetermined second delay that is after the active optical component completes light emission.

20 Claims, 8 Drawing Sheets

ACTIVE OPTICAL COMPONENT LIGHT EMISSION CONTROL METHOD

CROSS-REFERENCE TO RELATED APPLICATIONS

This is a continuation of International Patent Application No. PCT/CN2020/079801 filed on Mar. 18, 2020, which claims priority to Chinese Patent Application No. 201910223114.5 filed on Mar. 22, 2019. The disclosures of the aforementioned applications are hereby incorporated by reference in their entireties.

TECHNICAL FIELD

This application relates to the field of terminal technologies, and in particular, to an active optical component light emission control method.

BACKGROUND

Active optical components play a very important role in intelligent terminal devices such as mobile phones and tablet computers. The active optical components refer to components that actively emit light when working, and implement specific functions based on optical signals reflected by surrounding objects. Common active optical components include an optical proximity sensor, a time-of-flight (TOF) sensor, an iris recognition sensor, a dot projector for facial recognition, a flood illuminator, and the like. To prevent emitted light from being perceived by a user, these components usually emit infrared-band signals. In addition, to avoid blocking an optical path, it is a common means to open a hole in a housing of a mobile phone.

To implement a "bezel-less screen" phone with a higher screen-to-body ratio, it is a trend to place an active optical component below a screen to avoid opening a hole. However, under an existing condition, if an active optical component is simply placed below a display screen (for example, an organic light-emitting diode (LED) (OLED) display screen) and is not processed, when the active optical component emits light, the display screen may work abnormally and have a light spot, thereby affecting user experience.

SUMMARY

This application provides an active optical component light emission control solution, to reduce or eliminate impact of a light spot on a user.

According to a first aspect, this application provides an electronic device, including a display screen, a display control circuit, an active optical component, and an optical control circuit. The active optical component is located below the display screen. The display control circuit is configured to control refreshing of the display screen, and output a synchronization signal to the optical control circuit. The optical control circuit is configured to receive the synchronization signal, and control the active optical component to start light emission after a predetermined first delay after a moment corresponding to the synchronization signal, so that after a predetermined second delay after the active optical component completes light emission, the display control circuit refreshes to one row of at least one row on the display screen corresponding to the active optical component. The active optical component is allowed to work only after the first delay, and there is a second delay after the active optical component is controlled to work. In this way, the display screen may have a specific period of time for recovery, and after the second delay, one or more rows on the display screen corresponding to the active optical component are refreshed. This can control the second delay by using an experiment method or a test method, to weaken or eliminate a bright spot generated after the display screen is irradiated by light emitted by the active optical component.

In an implementation, the second delay is greater than or equal to duration Tmin for restoring a pixel of the display screen to a normal electrical characteristic after the pixel is irradiated by light emitted by the active optical component, and is less than sensitivity Tmax of human eyes to recognize an object. Because the second delay is greater than Tmin, all of affected characteristics of the active optical component can be restored. In addition, because the second delay is less than Tmax, in practice, although a bright spot temporarily exists in this duration, it is not perceived by human eyes. Therefore, when the second delay meets the foregoing conditions, a better effect of weakening or eliminating the bright spot may be obtained. In an implementation, Tmax is 2.5 milliseconds (ms), and Tmin is 1.5 ms.

In another implementation, the synchronization signal includes a frame synchronization signal, and when the optical control circuit is configured to receive the synchronization signal, and control the active optical component to start light emission after the predetermined first delay after the moment corresponding to the synchronization signal, the optical control circuit is further configured to receive the frame synchronization signal, and after receiving the frame synchronization signal, control the active optical component to start light emission and complete work after the first delay. Because the frame synchronization signal is an existing commonly used synchronization signal, when synchronization is implemented based on the existing signal, hardware changes are few, synchronization is easy to be implemented, and design costs are reduced.

In another implementation, the synchronization signal includes a frame synchronization signal, and the optical control circuit is further configured to receive row synchronization signals sent by the display control circuit, and when the optical control circuit is configured to receive the synchronization signal, and control the active optical component to start light emission after the predetermined first delay after the moment corresponding to the synchronization signal, the optical control circuit is further configured to, after receiving the frame synchronization signal, start to count a quantity of the subsequently received row synchronization signals, to control the active optical component to perform the first delay and to start light emission and complete work after the first delay is performed. Synchronization and delay are implemented by using a frame synchronization signal and one or more row synchronization signals, to provide another possible implementation and extend the implementation. In addition, delay may be implemented based on the row synchronization signals in this solution, and no specific period of timer is required. This can reduce timer usage and is applicable to a scenario in which timer resources are relatively small or even unavailable.

In another implementation, the optical control circuit is further configured to control the active optical component, after the active optical component starts light emission, to continuously work at first power for first duration, so as to weaken or eliminate a bright spot generated after the display screen is irradiated by light emitted by the active optical component. The active optical component is controlled to work at the specific power and working duration, so that the bright spot generated after the display screen is irradiated can be weakened or eliminated.

In another implementation, second duration is equal to a sum of the first delay, the second delay, and duration from a moment at which the active optical component starts light emission to a moment at which the active optical component completes light emission, and the second duration is less than one frame period, or is greater than one frame period and less than two frame periods. By controlling the second duration within one frame period or within one or two frame periods, it can be ensured that the second duration is completed as soon as possible when a working performance requirement is met, and timeliness is ensured. In addition, different duration may be controlled for different hardware scenarios. For example, for a scenario in which the active optical component is disposed relatively far from the top of the display screen of the electronic device, the second duration may be controlled within one frame period. For a scenario in which the active optical component is disposed relatively close to the top of the display screen of the electronic device, the second duration may be controlled within one or two frame periods.

In another implementation, one work period is from a moment at which the optical control circuit receives a synchronization signal to the moment at which the active optical component completes light emission, and when the display screen is in a screen-on state, the optical controller controls the active optical component to continue working for one or more work periods. By continuing working for one or more periods, more application requirements can be met. For example, some applications need to use an optical component for a long term, so this requirement can be met through working in more periods.

In another implementation, the display screen is an OLED display screen or a micro LED display screen. Because light transmittance of the OLED display screen and light transmittance of the micro LED display screen are relatively great, light of the active optical component can be transmitted at this stage, so that working requirements are met. Certainly, this application does not limit another type of display screen that can meet a light transmittance requirement at the current stage or in the future.

In another implementation, the active optical component is an optical proximity sensor, a TOF sensor, an iris recognition sensor, a dot projector, or a flood illuminator.

In another implementation, when a screen is in an off state, work may be performed in a predetermined or an existing working manner of the active optical component. Therefore, the existing manner may be used, so that improvements are small, and design costs are reduced.

In another implementation, there is a process of switching between a screen-on state and a screen-off state. In this case, the active optical component may work in a screen-on state or a screen-off state based on an on or off state of the screen. For example, if the display screen is in a screen-on state, work may be performed according to the first aspect and related implementations, or if the display screen is in a screen-off state, the work may be performed in a predetermined or existing manner. In this way, both a screen-on scenario and a screen-off scenario can be considered, so that compatibility is better, and user experience is improved.

In another implementation, a screen-off state may be determined by detecting whether there is a frame synchronization signal. If it is detected that there is frame synchronization, the screen is in a screen-on state, otherwise, the screen is a screen-off state. Because the frame synchronization signal is existing, implementation is simple and costs are reduced.

According to a second aspect, this application provides an electronic device, including a display screen, a display control circuit, an active optical component, and an optical control circuit. The active optical component is located below the display screen. The display control circuit is configured to control refreshing of the display screen, and output a synchronization signal to the optical control circuit. The optical control circuit is configured to receive the synchronization signal, and control a start moment and working duration of the active optical component, so that after a predetermined second delay after the active optical component completes light emission, the display control circuit refreshes to one row of at least one row on the display screen corresponding to the active optical component.

In an implementation, the second delay is greater than or equal to duration Tmin for restoring a pixel of the display screen to a normal electrical characteristic after the pixel is irradiated by light emitted by the active optical component, and is less than sensitivity Tmax of human eyes to recognize an object.

In an implementation, the synchronization signal includes a frame synchronization signal, and when the optical control circuit is configured to receive the synchronization signal, and control the start moment and the working duration of the active optical component, the optical control circuit is further configured to receive the frame synchronization signal, and after receiving the frame synchronization signal, control the active optical component to start light emission and complete work after the first delay.

In an implementation, the synchronization signal includes a frame synchronization signal, and the optical control circuit is further configured to receive row synchronization signals sent by the display control circuit, and when the optical control circuit is configured to receive the synchronization signal, and control the start moment and the working duration of the active optical component, the optical control circuit is further configured to, after receiving the frame synchronization signal, start to count a quantity of the subsequently received row synchronization signals, to control the active optical component to perform the first delay and to start light emission and complete work after the first delay is performed.

In an implementation, the optical control circuit is further configured to control the active optical component, after the active optical component starts light emission, to continuously work at first power for first duration.

In an implementation, second duration is equal to a sum of the first delay, the second delay, and duration from a moment at which the active optical component starts light emission to a moment at which the active optical component completes light emission, and the second duration is less than one frame period, or is greater than one frame period and less than two frame periods.

In an implementation, one work period is from a moment at which the optical control circuit receives a synchronization signal to the moment at which the active optical component completes light emission, and the method further includes, when the display screen is in a screen-on state, the optical controller controls the active optical component to continue working for one or more work periods.

In an implementation, the display screen is an OLED display screen or a micro LED display screen.

According to a third aspect, this application discloses an electronic device, including a display screen, a display control circuit, an active optical component, and an optical control circuit. The active optical component is located below the display screen. The display control circuit is configured to control refreshing of the display screen, and output a synchronization signal to the optical control circuit. The optical control circuit is configured to receive the synchronization signal, and control a start moment and working duration of the active optical component, so that when the display control circuit refreshes to one row of at least one row on the display screen corresponding to the active optical component, an electrical characteristic of a pixel that is in the row of the at least one row on the display screen and that is irradiated by the active optical component has been restored, and no light spot that is recognized by human eyes is generated.

In an implementation, the second delay is greater than or equal to duration Tmin for restoring a pixel of the display screen to a normal electrical characteristic after the pixel is irradiated by light emitted by the active optical component, and is less than sensitivity Tmax of human eyes to recognize an object.

In an implementation, the synchronization signal includes a frame synchronization signal, and when the optical control circuit is configured to receive the synchronization signal, and control the start moment and the working duration of the active optical component, the optical control circuit is further configured to receive the frame synchronization signal, and after receiving the frame synchronization signal, control the active optical component to start light emission and complete work after the first delay.

In an implementation, the synchronization signal includes a frame synchronization signal, and the optical control circuit is further configured to receive row synchronization signals sent by the display control circuit, and when the optical control circuit is configured to receive the synchronization signal, and control the start moment and the working duration of the active optical component, the optical control circuit is further configured to, after receiving the frame synchronization signal, start to count a quantity of the subsequently received row synchronization signals, to control the active optical component to perform the first delay and to start light emission and complete work after the first delay is performed.

In an implementation, the optical control circuit is further configured to control the active optical component, after the active optical component starts light emission, to continuously work at first power for first duration.

In an implementation, second duration is equal to a sum of the first delay, the second delay, and duration from a moment at which the active optical component starts light emission to a moment at which the active optical component completes light emission, and the second duration is less than one frame period, or is greater than one frame period and less than two frame periods.

In an implementation, one work period is from a moment at which the optical control circuit receives a synchronization signal to the moment at which the active optical component completes light emission, and the method further includes, when the display screen is in a screen-on state, the optical controller controls the active optical component to continue working for one or more work periods.

In an implementation, the display screen is an OLED display screen or a micro LED display screen.

According to a fourth aspect, this application discloses an optical module, applied to the electronic device according to the first aspect to the third aspect and the implementations of the various aspects. The optical module includes an active optical component and an optical control circuit, and the electronic device includes the optical module, a display screen, and a display control circuit. The active optical component is located below the display screen. The display control circuit is configured to control refreshing of the display screen, and output one or more synchronization signals to the optical control circuit.

According to a fifth aspect, this application discloses an active optical component control method. The control method is performed by the optical control circuit according to the first aspect to the third aspect and the implementations of the various aspects, so as to implement functions to be implemented by the optical control circuit according to the first aspect to the third aspect and the implementations of the various aspects.

According to a sixth aspect, this application discloses an optical control circuit. The optical control circuit is the optical control circuit in the electronic device according to the first aspect to the third aspect and the implementations of the various aspects, and is configured to perform various functions in the optical control circuit according to the first aspect to the third aspect and the implementations of the various aspects. The optical control circuit may include a processing circuit and a memory. The processing circuit is configured to read code stored in the memory, and execute the read code, to implement functions to be implemented by the optical control circuit in the first aspect and the implementations of the first aspect. Alternatively, the optical control circuit may be implemented based on a hardware circuit such as an application-specific integrated circuit (ASIC) or a field-programmable gate array (FPGA), and may include various sub-circuits inside to implement functions of the optical control circuit in this application. Details are not described in this application again.

BRIEF DESCRIPTION OF DRAWINGS

To describe the technical solutions in some of the embodiments of this application more clearly, the following briefly describes the accompanying drawings used in describing some of the embodiments. It is clear that the accompanying drawings in the following description show merely some embodiments of this application, and a person of ordinary skill in the art may still derive other drawings from these accompanying drawings without creative efforts.

DESCRIPTION OF EMBODIMENTS

The following describes the embodiments of this application with reference to the accompanying drawings.

Figure 1:
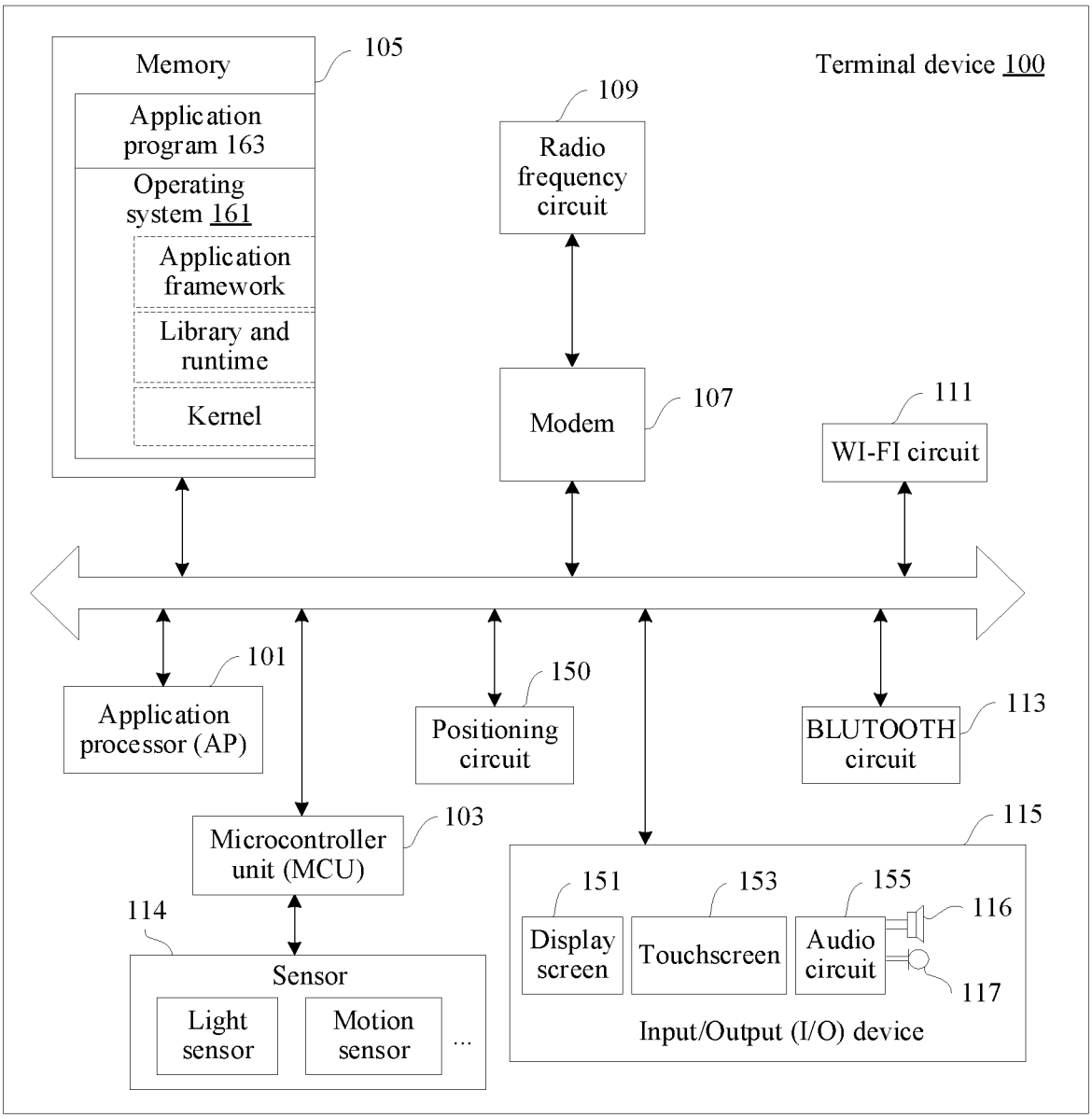
FIG. 1 is a schematic structural diagram of a terminal device according to this application.

The technical solutions in this application may be applied to various terminal devices (such as a mobile phone, a tablet computer, or a notebook computer), or another electronic device. A terminal device is used as an example. FIG. 1 shows a schematic structural diagram of an example of a terminal device 100. According to FIG. 1, the terminal device 100 includes components such as an application processor 101, a microcontroller unit (MCU) 103, a memory 105, a modem 107, a radio frequency (RF) module 109, a WI-FI module 111, a BLUETOOTH module 113, a sensor 114, a positioning module 150, and an input/output (I/O) device 115. These components can communicate with each other by using one or more communications buses or signal lines. A person skilled in the art may understand that a hardware structure shown in FIG. 1 does not constitute a limitation on the terminal device. The terminal device 100 may include more or fewer components than those shown in the figure, or combine some components, or have different component arrangements.

The following describes each component of the terminal device 100 in detail with reference to FIG. 1.

The application processor 101 is a control center of the terminal device 100, and is connected to each component of the terminal device 100 through various interfaces and by using various buses. In some embodiments, the application processor 101 may include one or more processing circuits (or also referred to as "processing cores"), for example, including a central processing unit (CPU) core, a graphics processing unit (GPU) core, and an image signal processor (ISP) core.

The memory 105 stores a computer program, for example, an operating system 161 and an application program 163 shown in FIG. 1. The application processor 101 is configured to execute the computer program in the memory 105, to implement a function defined by the computer program. For example, the application processor 101 executes the operating system 161, to implement various functions of the operating system on the terminal device 100. The memory 105 further stores data other than the computer program, for example, data generated in a running process of the operating system 161 and the application program 163. The memory 105 generally includes an internal memory and an external memory. The internal memory includes but is not limited to a random-access memory (RAM), a read-only memory (ROM), a cache, or the like. The external memory includes but is not limited to a flash memory, a hard disk, an optical disc, a Universal Serial Bus (USB) flash drive, or the like. The computer program is usually stored in the external memory. Before executing the computer program, the processor loads the program from the external memory to the internal memory.

The memory 105 may be independent, and is connected to the application processor 101 by using a bus. Alternatively, the memory 105 and the application processor 101 may be integrated into a chip subsystem.

The MCU 103 is a coprocessor configured to obtain and process data from the sensor 114. A processing capability and power consumption of the MCU 103 are less than those of the application processor 101, but the MCU 103 may have a feature of "always on", and can continuously collect and process the data from the sensor when the application processor 101 is in a sleep mode, to ensure normal running of the sensor with relatively low power consumption. In an embodiment, the MCU 103 may be a sensor hub chip. The sensor 114 may include an active optical sensor (for example, an optical proximity sensor, a TOF sensor, an iris recognition sensor, a dot projector for facial recognition, or a flood illuminator), and various motion sensors (such as an acceleration sensor and a gyroscope). The MCU 103 and the sensor 114 may be integrated into a same chip, or may be separate components and are connected by using a bus.

The modem 107 and the radio frequency module 109 constitute a communications subsystem of the terminal device 100, and are configured to implement main functions of a wireless communications standard protocol such as the 3rd Generation Partnership Project (3GPP) or the European Telecommunications Standards Institute (ETSI). The modem 107 is configured to perform coding/decoding, signal modulation/demodulation, equalization, and the like. The radio frequency module 109 is configured to receive and send a radio signal, and the radio frequency module 109 includes but is not limited to an antenna, at least one amplifier, a coupler, a duplexer, and the like. The radio frequency module 109 cooperates with the modem 107 to implement a wireless communications function. The modem 107 may be used as an independent chip, or may be used together with another chip or circuit to form a system-level chip or an integrated circuit (for example, may alternatively be integrated with the application processor 101 into one chip or integrated circuit). The chip or integrated circuit may be applied to all terminal devices that implement the wireless communications function, and include a mobile phone, a computer, a notebook computer, a tablet computer, a router, a wearable device, a vehicle, a household appliance, and the like.

The terminal device 100 may further perform wireless communications by using the WI-FI circuit 111, the BLUETOOTH circuit 113, or the like, and determine a geographical location of the terminal device 100 by using the positioning circuit 150 (for example, a circuit based on a Global Positioning System (GPS) or a BEIDOU navigation satellite system). These circuits may be independent chips or integrated circuits, or may be partially or all integrated together, or may be partially or all integrated with another circuit into one chip or integrated circuit. For example, in an embodiment, the WI-FI module 111, the BLUETOOTH module 113, and the positioning module 150 may be integrated into a same chip. In another embodiment, the WI-FI module 111, the BLUETOOTH module 113, the positioning module 150, and the MCU 103 may also be integrated into a same chip.

The input/output device 115 includes but is not limited to a display screen 151, a touchscreen 153, an audio circuit 155, and the like.

The touchscreen 153 may collect a touch event performed by a user of the terminal device 100 on or near the touchscreen 153, and send the collected touch event to another component (for example, the application processor 101).

The display screen (also referred to as a display) 151 is configured to display information input by the user or information displayed to the user. The display screen may be a liquid crystal display screen or a display screen in a form of an OLED, or the like.

The audio circuit 155, a speaker 116, and a microphone 117 may provide an audio interface between the user and the terminal device 100, and is configured to collect a voice of the user or play audio.

A person skilled in the art may understand that the terminal device 100 may include fewer or more components than those shown in FIG. 1. The person skilled in the art may make adjustments with reference to application requirements. Details are not described in this application.

Embodiment 1

Based on the foregoing background, the solutions of this application are described in detail in this embodiment.

In this application, to implement a "bezel-less screen" terminal device with a higher screen-to-body ratio, some active optical components may be placed below a display screen. In this way, there is no need to further open holes for these active optical components, thereby implementing a higher screen-to-body ratio. In view of solution feasibility, a widely used OLED display panel has a transmittance of 5% to 10% to commonly used infrared light with 850 nm and 940 nm wavelengths. Therefore, it is feasible to place various active optical components below the display screen.

However, after these active optical components are placed below the display screen, a display exception may occur when pixels of the display screen are irradiated by these active optical components. For example, an OLED display screen is used as an example, where the OLED display screen includes an OLED pixel array. Light (which is usually infrared light, and this application uses infrared light as an example for description) emitted by an active optical component irradiates an active layer (a channel) of a thin film transistor (TFT) of a pixel of the OLED display screen, so that photogenerated charge carriers are generated in the active layer, to cause a TFT threshold voltage shift. A user may intuitively see a light spot (a bright spot or a dark spot) generated because a drive current of the pixel irradiated by the infrared light is different from drive currents of surrounding pixels. This case is further described below with reference to FIG. 2.

Figure 2:
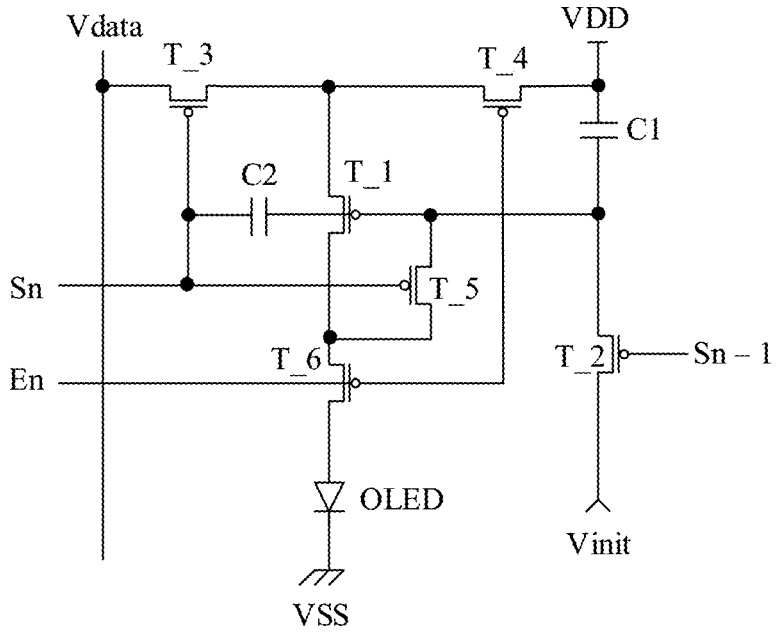
FIG. 2 is a schematic structural diagram of a display screen pixel according to this application.

FIG. 2 is a circuit structural diagram of a single pixel of an OLED display screen, including an OLED light-emitting unit (represented by "OLED" in the figure) and a TFT drive circuit. The TFT drive circuit includes a TFT transistor T_1, a TFT transistor T_2, and a capacitor C1. The remaining circuits are circuits for selection or charging. In this application, a light spot is generated mainly because the TFT drive circuit is affected by illumination. Therefore, the following mainly describes the TFT drive circuit in detail in this application. A form used by another circuit is not limited in this application. It should be noted that this example is merely one implementation, and a person skilled in the art is not limited in this application to adaptively improve this example.

The capacitor C1 stores luminance information of the pixel. C1 applies a voltage to a gate of T_1 to control an output current of a drain of T_1, to further control luminance of the pixel. T_2 controls whether C1 is grounded. When the pixel is in a display state, T_2 is in an off state. When display information is refreshed, T_2 is first switched on to release charges in C1, and then is switched off. In this case, new display information is written into C1 through a charging path. For example, Sn−1 is set to a low level, and Sn is set to a high level, that is, T_2 is switched on, T_3 and T_5 are switched off, then, the charges stored in C1 are released, so that information about the pixel is cleared or initialized, subsequently, Sn−1 is set to a high level, and Sn is set to a low level, that is, T_2 is switched off, and T_3 and T_5 are switched on, and in this case, because the gate and the drain of T_1 are short-circuited, T_1 works in a diode manner, so that a difference between Vdata and a threshold voltage of T_1 is input to a gate side of T_1, that is, the difference is written into the capacitor C1.

Impact of infrared light irradiation on the drive circuit of the pixel exists in two aspects. In a first aspect, an I-V characteristic is affected when T_1 is irradiated by infrared light, and an output current becomes larger under a same gate voltage, causing the pixel to become brighter, in a second aspect, T_2 is partially switched on, causing the charges stored in C1 to leak, and in this case, the gate voltage of T_1 is reduced, the output current is reduced, and the pixel becomes darker. During infrared light irradiation, impact in the first aspect is stronger than that in the second aspect, and a bright spot appears in an irradiation area. After the infrared light irradiation completes, the impact in the second aspect plays a leading role, and a dark spot appears in the irradiation area. Therefore, to improve a display effect, the light spot needs to be weakened, that is, at least the bright spot or the dark spot needs to be weakened or eliminated, or the bright spot and the dark spot need to be weakened or eliminated at the same time.

Figure 3:
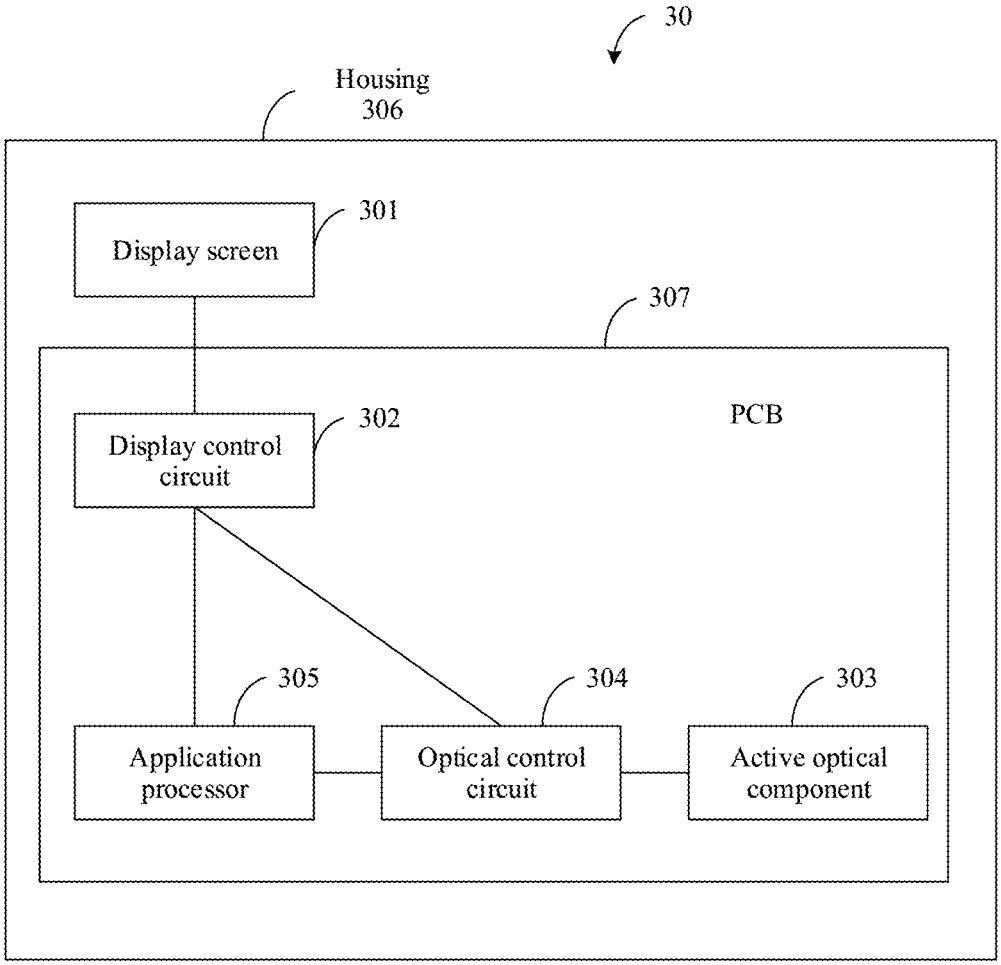
FIG. 3 is a schematic structural diagram of an electronic device according to this application.

Based on the foregoing background, this application discloses an electronic device. FIG. 3 is a schematic diagram of a logical structure of an electronic device 30 according to this application. Circuits related to a display screen and an optical sensor are described in more details in this application compared with these in FIG. 1. To be specific, the electronic device 30 includes a display screen 301, a display control circuit 302, an active optical component 303, and an optical control circuit 304, and further includes an application processor 305, a housing 306 (that is configured to support and protect internal circuits), and a printed circuit board (PCB) 307 (that is configured to place various circuits, where traces on the PCB are further configured to provide signal connections). For simplicity, the display control circuit is not shown in FIG. 1, which is further described in FIG. 3 and FIG. 4.

Figure 4:
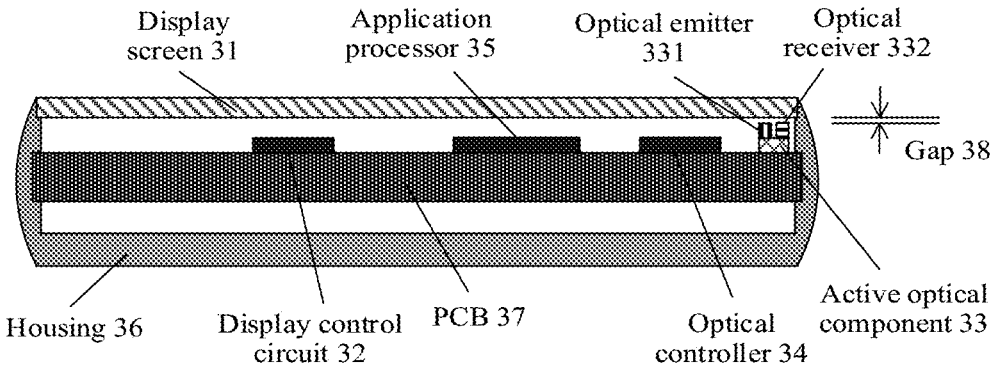
FIG. 4 is a sectional view of an electronic device according to this application.

FIG. 4 is a sectional view of an electronic device according to this application. In this embodiment, an active optical component 33 is placed on a PCB 37, and is also located below a display screen 31. The active optical component 33 may include an optical emitter 331 for emitting light (infrared light) and an optical receiver 332 for receiving light. A gap 38 may exist between the active optical component 33 and the display screen 31.

In this application, the display screen, the display control circuit, the active optical component, and the optical control circuit may all be implemented based on existing circuit structures. The following separately describes the circuits or components.

The display screen includes a pixel array, and is configured to display, for example, an image or a video under control of an application processor. In this embodiment, a display screen whose light transmittance can meet a working requirement of the active optical component, for example, an OLED or a micro LED, may be selected, or may be another display screen that can implement a similar function.

The display control circuit is separately connected to the pixel array and the optical control circuit. In one aspect, the display control circuit is configured to control display of the display screen, that is, when the display screen needs to work, the display control circuit is configured to control refreshing of the display screen, so that the display screen can display an image or a video. In another aspect, the display control circuit is configured to output a synchronization signal to the optical control circuit. The optical control circuit may be integrated into the microcontroller (for example, a sensor hub) in FIG. 1, or may be an independent component, or may be integrated into the access point (AP).

The active optical component includes the optical emitter and the optical receiver. The optical emitter is configured to emit light (for example, infrared light). After passing through a screen and irradiating an object outside the screen, the emitted light is reflected, passes through the screen again, and then is received by the optical receiver of the active optical component. To avoid opening a hole in the screen, in this application, the active optical component is located below the display screen. It may be understood that, because the light emitted by the active optical component needs to pass through the display screen, the display screen needs to use a material, that meets a light transmittance requirement, for example, an OLED, a micro LED, or another material that meets the requirement.

The optical control circuit is connected to the active optical component and the display control circuit. In one aspect, the optical control circuit is configured to control the active optical component to work. In another aspect, the optical control circuit is configured to receive the synchronization signal sent by the display control circuit (where the synchronization signal can be received through a dedicated pin), and control working duration of the active optical component based on the synchronization signal, to weaken or eliminate a light spot. In addition, the optical control circuit and the display control circuit are connected to the application processor, and are configured to work under the control of the application processor. Further, the display control circuit is configured to output corresponding display data under the control of the application processor. The optical control circuit is configured to control, under the control of the application processor, the active optical component to work at an appropriate occasion. For example, when the application processor needs to make the active optical component work, the application processor sends, to the optical control circuit, a working instruction that is used to instruct to work, and after the optical control circuit receives the working instruction, the optical control circuit controls the active optical component to start to work. The optical control circuit may include a processing circuit and a memory. The processing circuit may be an instruction set-based processing circuit such as a CPU, and may be configured to read code stored in the memory to work. Alternatively, the optical control circuit may be implemented based on hardware, for example, an FPGA or an ASIC.

Further, the optical control circuit is configured to control, based on the received synchronization signal, the active optical component to start light emission after T1 after a moment corresponding to the synchronization signal, and to complete light emission after duration T2 (it is assumed that duration in which the active optical component completes a dedicated task is less than or equal to T2). After T3 after the active optical component completes light emission, the display control circuit refreshes to one row of at least one row on the display screen corresponding to the active optical component. The moment corresponding to the synchronization signal is a moment having correspondence with the synchronization signal, for example, it may be a moment at which the synchronization signal is received, or may be a sum of a moment at which the synchronization signal is received and an offset (that is, a sum of the moment at which the synchronization signal is received and duration). It may be understood that T1 is a number greater than or equal to 0, and T2 and T3 are numbers greater than 0. In the duration T1, the duration T3, and duration in which the display control circuit refreshes to at least one row on the display screen corresponding to the active optical component, the active optical component does not emit light, or work at a power level that does not affect display of the display screen. In the foregoing solution, a light spot generated after a pixel of the display screen is irradiated by light emitted by the active optical component may be weakened.

Because appearance duration of a dark spot is from a moment at which infrared light emission completes to a moment at which an image in an illumination area is refreshed again (that is, longest appearance duration of the dark spot can be up to 16.67 ms), the dark spot is more easily perceived by human eyes than a bright spot. After the image in the infrared irradiation area is refreshed, because a capacitor is discharged and recharged, a displayed image is restored to normal. Therefore, a key to resolve a light spot problem is to resolve a dark spot problem. Referring to FIG. 2, because an electrical characteristic of the TFT transistor T_2 is not restored immediately after the infrared light irradiation completes, and it usually takes about 1.5 ms, it needs to be ensured that the characteristic of the TFT transistor T_2 has been restored to normal when the image in the infrared irradiation area is refreshed. Otherwise, if T_2 is not fully switched off after the image is refreshed, charge leakage still occurs in the C1, and consequently, the dark spot reappears. Therefore, by using the foregoing method of this embodiment, it needs to properly set T1, T2, and T3 to enable, after irradiation and before refresh, the characteristic of the TFT transistor T_2 to be restored to normal as much as possible, and enable, after the dark spot appears, the image in the irradiation area to be refreshed as soon as possible.

In this application, the synchronization signal is a signal that is output by the display control circuit and that is used to identify a refreshing location, so that the optical control circuit can start to work synchronously based on the signal. Further, the synchronization signal may include a frame synchronization signal, or include a frame synchronization signal and row synchronization signals. Further, an image on the display screen is refreshed usually in a row-by-row refreshing manner. A commonly used display screen with 2000 rows of pixels and a 60 hertz (Hz) refreshing frequency is used as an example. The display screen is refreshed row by row once from a first row to a last row within frame duration of 16.67 ms. Therefore, a refreshing interval between two adjacent rows is: 16.67 ms/2000=8.3 microseconds (μs). The display control circuit outputs a signal that identifies a refreshing moment for another circuit (for example, the optical control circuit). The frame synchronization signal is a most commonly used synchronization signal, and the signal outputs a refreshing flag each time the first row of the display screen starts to be refreshed. In addition, row synchronization signals can also be output for the other circuit.

In this embodiment, a dark spot may be eliminated by controlling T1. However, a specific value of T1 may be based on T2 and T3, and may be related to duration T4 that is obtained from a moment t0 at which the optical control circuit receives the synchronization signal to a moment t3 at which one or more rows on the display screen corresponding to the active optical component are refreshed. Because of the delay T3, a pixel-related circuit (for example, the TFT transistor T_2 in the drive circuit) of the display screen can be restored to a normal characteristic in specific recovery duration. After the characteristic of the circuit is restored, refreshing is performed (when a row is refreshed, capacitors corresponding to all pixels in the row are discharged first, and then new display information is written through a charging path). In this case, there is no dark spot. Therefore, the dark spot can be weakened or eliminated by using the foregoing method.

In this embodiment, T3 may be further determined by using a test method. To be specific, different duration is set to observe a dark spot, and if the dark spot weakens or disappears, corresponding duration is selected as a value of T3.

In another implementation, T3 may alternatively be set to be greater than duration Tmin (about 1.5 ms) for restoring a pixel of the display screen to a normal electrical characteristic after a drive circuit in the pixel is irradiated by light, and less than sensitivity Tmax of human eyes to recognize an object. The sensitivity indicates shortest duration in which a target (for example, an object or light) is recognized by the human eyes, and in other words, when appearance duration of a target is less than the duration, the target cannot be recognized by the human eyes, where the duration is about 2.5 ms. It should be noted that, the "normal electrical characteristic" in this application is an electrical characteristic that is restored to basically the same as that before irradiation, where they may be the same, or may have some minor differences. With reference to an actual application scenario, a performance indicator, a component process, and the like, a person skilled in the art may determine an index of the normal electrical characteristic and the duration for restoring the pixel to the normal electrical characteristic, and finally weaken or eliminate the light spot.

In this embodiment, the at least one row on the display screen corresponding to the active optical component is a row area in which a pixel whose characteristic is affected when the pixel on the display screen is irradiated by light emitted by the active optical component is located, and relates to one or more rows. For example, when the active optical component emits light, a pixel area is irradiated and affected through illumination, that is, a drive circuit of the pixel is affected as described above, and then a light spot is generated. For example, a row corresponding to the pixel area may be located between a $300^{th}$ row and a $350^{th}$ row. At the moment t3, it may be refreshed to a first row of the pixel region (for example, the $300^{th}$ row) or another row (for example, a row between the $300^{th}$ row and the $350^{th}$ row) provided that the light spot can be weakened or eliminated. In addition, because a row refreshing interval is very small, and a quantity of rows to be affected is small, which specific moment is selected as t3 has little impact on the entire solution, and a person skilled in the art may select a proper moment with reference to an actual application and test.

In this embodiment, in addition to controlling the dark spot, the bright spot may be also controlled to further reduce the impact of the light spot on a person. Further, in a bright spot control method, the bright spot becomes invisible to human eyes by reducing power and duration of light emitted by the active optical component. For example, the power is reduced by controlling a current of the active optical component, and the duration is controlled within specific duration. Certainly, when the foregoing control is performed, it also needs to be ensured that the active optical component can complete normal work. A specific power value and duration may be obtained by using an experiment and a test method for different optical sensor components. For example, emission parameters of the active optical component may be set as follows. One pulse is emitted each time, a pulse width is 32 μs, and a drive current is 50 mA.

Embodiment 2

Based on Embodiment 1, a specific working procedure of the electronic device is described in detail in this embodiment.

Figure 5:
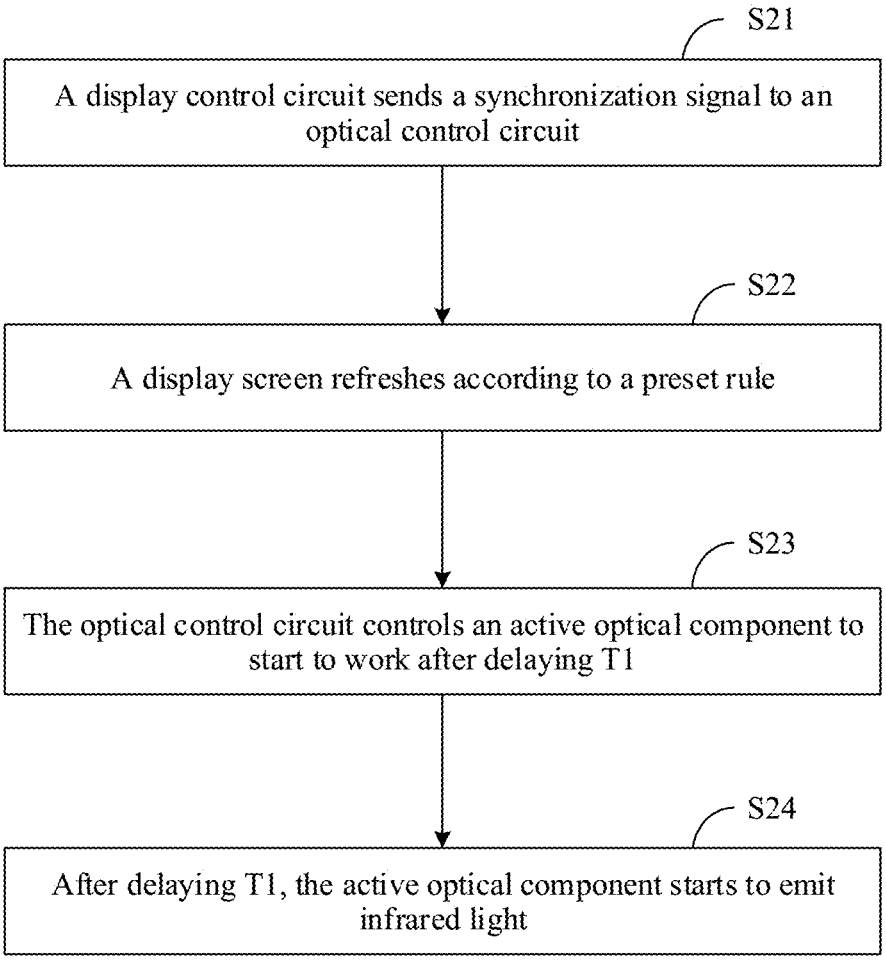
FIG. 5 is a schematic diagram of a working procedure of an electronic device according to this application.
Figure 6:
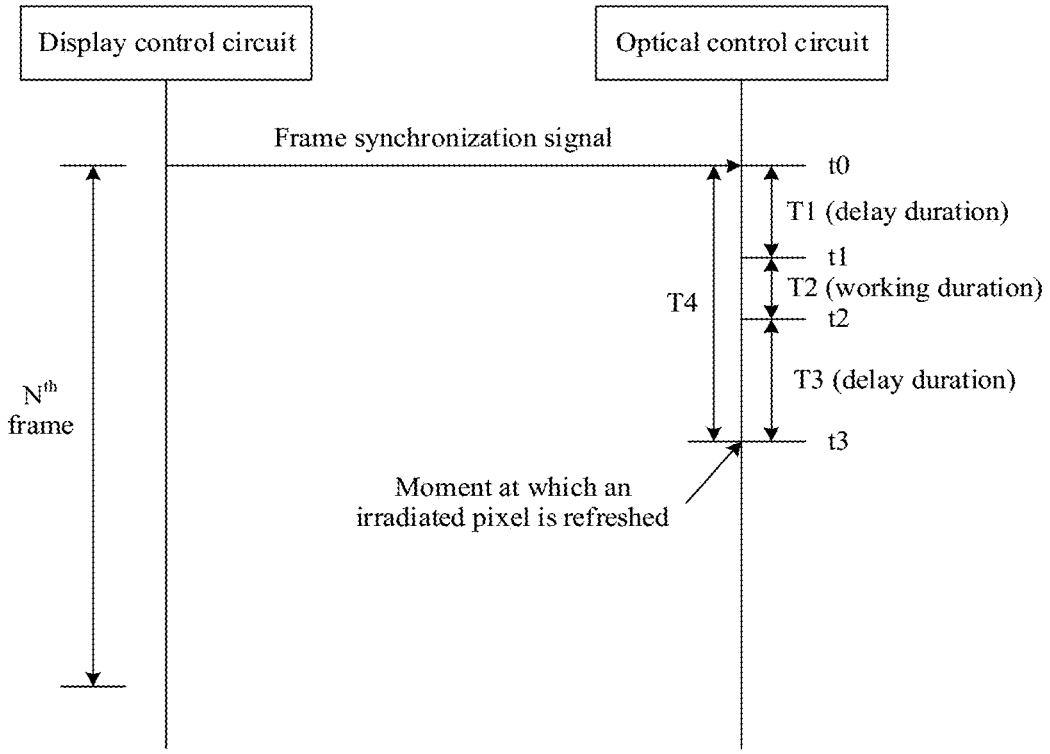
FIG. 6 is a schematic diagram of a working process of an electronic device according to this application.

FIG. 5 to FIG. 7 are respectively a schematic diagram of a working procedure of an electronic device according to this application and two schematic diagrams of a working process of the electronic device according to this application. The following describes this solution in detail with reference to FIG. 5 to FIG. 7.

Referring to FIG. 5, the following steps are included.

S21: The display control circuit sends a synchronization signal to the optical control circuit.

Referring to FIG. 6, the synchronization signal includes a frame synchronization signal. The frame synchronization signal is a signal that is output by the display control circuit each time a frame starts to be refreshed when the display control circuit controls to refresh the display screen. The signal is output to the optical control circuit, so that the optical control circuit controls the active optical component to work based on the signal.

As shown in FIG. 6, it is assumed that at a start moment t0 of a frame, the display control circuit sends a frame synchronization signal to the optical control circuit.

Figures 7A, 7B, 7C, 7D:
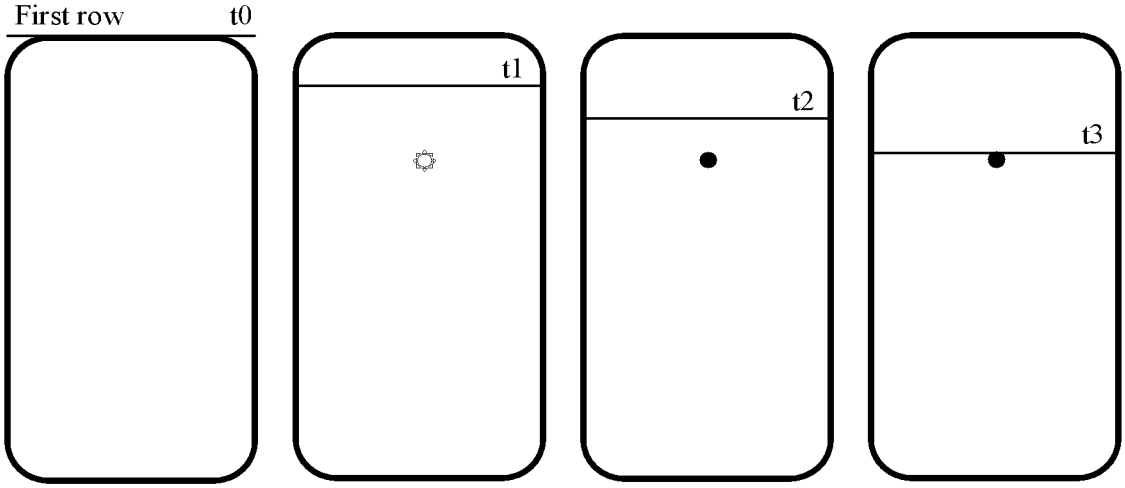
FIG. 7A, FIG. 7B, FIG. 7C, and FIG. 7D are schematic diagrams of processes in which a light spot generates and disappears and a working process of an electronic device according to this application.

As shown in FIGS. 7A-7D, each horizontal line represents a refreshed row. As shown in FIG. 7A, a first row is refreshed at a moment to. In this case, no light spot occurs.

S22: The display screen refreshes according to a preset rule.

For example, refreshing is performed in a row refreshing manner. A commonly used display screen with 2000 rows of pixels and a 60 Hz refreshing frequency is used as an example. The display screen is refreshed row by row once from a first row to a last row within frame duration of 16.67 ms. Therefore, a refreshing interval between two adjacent rows is: 16.67 ms/2000=8.3 μs. Certainly, another refreshing manner is not limited in this application.

S23: The optical control circuit controls the active optical component to start to work after delaying T1.

After receiving the synchronization signal, the optical control circuit controls the active optical component to start to work after delaying T1. Further, the optical control circuit may first wait for the duration T1, and then send a working instruction to the active optical component after the duration T1 expires, so that the active optical component starts to work after receiving the working instruction. In addition, if the active optical component supports automatic working after delaying a period of time, a configuration command (for example, a register configuration command) may further be sent to the active optical component through an interface to configure the active optical component, so that the active optical component automatically starts to work after delaying T1.

As shown in FIG. 6, duration from t0 to t1 is T1, and within this duration, the active optical component does not work. T1 may be determined based on T2, T3, and T4. For example, T1 may be calculated by using the following formula:

$$T1=T4-T2-T3.$$

T4 is a value that can be calculated in advance. For example, when a pixel affected by light emitted by the active optical component is in a $100^{th}$ row, and the 8.3 μs row refreshing interval as an example in step S22 is used as an example, T4=100*8.3 μs=830 μs.

T2 is working duration of the active optical component and may also be set in advance.

A method for setting T3 has been described in Embodiment 1. For example, Tmin<T3<Tmax may be set.

S24: After delaying T1, the active optical component starts to emit infrared light.

The active optical component starts to emit infrared light after delaying T1, and works for the duration T2. For details, refer to a requirement on emission of the active optical component in Embodiment 1 (for example, the power and duration of light emitted by the active optical component are reduced), to weaken a bright spot.

At the moment t1, the active optical component starts to emit light. In this case, if no processing is performed, as shown in FIG. 7B, the drive circuit of the pixel of the display screen is affected by illumination, and consequently, a bright spot appears. In this application, by using a method of reducing the power and duration of light emitted by the active optical component, a bright spot may be weakened or even avoided.

Referring to FIG. 7C, after the active optical component completes work (that is, after the working duration T2, the moment t2 is reached), a dark spot appears. Referring to FIG. 7D, after a delay T3, the pixel affected by light emitted by the active optical component is refreshed (at the moment t3), the dark spot is eliminated, and provided that T3 is set according to the foregoing method, the dark spots is not perceived by the human eyes.

Embodiment 3

Based on the foregoing embodiments, this solution is described in this embodiment by using an example in which synchronization signals include a frame synchronization signal and row synchronization signals.

Figure 8:
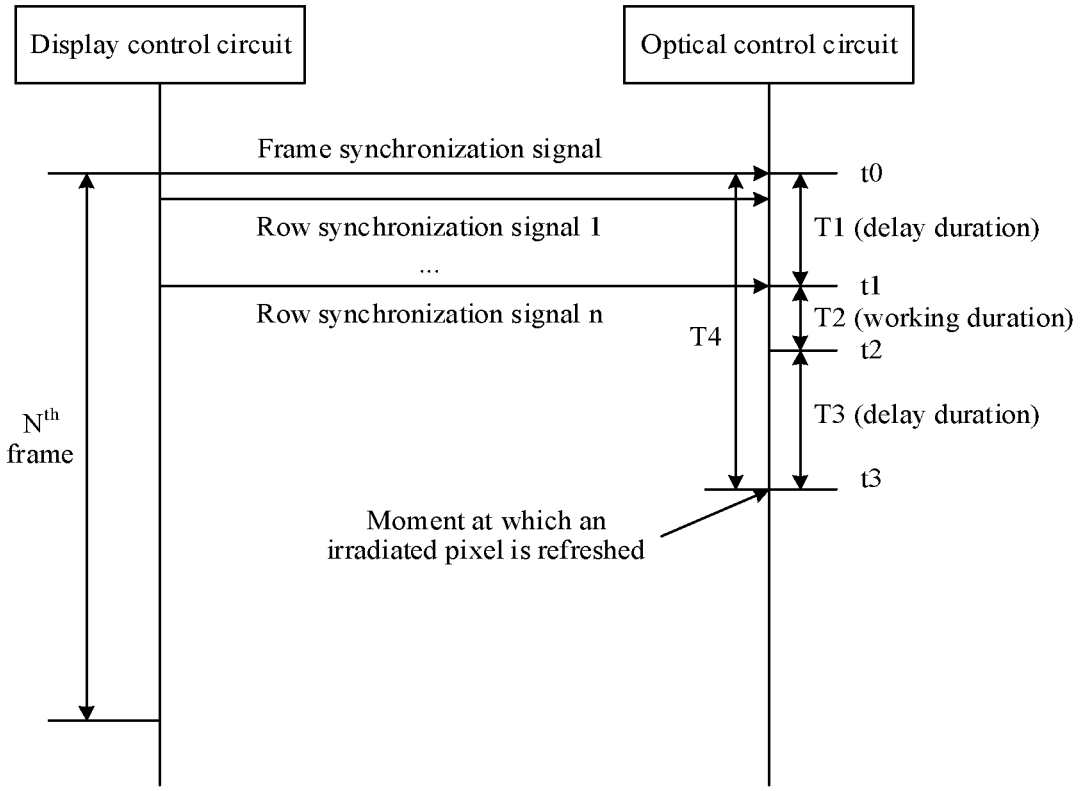
FIG. 8 is a schematic diagram of another working process of an electronic device according to this application.

FIG. 8 is a schematic diagram of a working solution when synchronization signals include a frame synchronization signal and row synchronization signals. As described above, the frame synchronization signal is output once in each frame, and the row synchronization signal is output in each row. In hardware, two types of signals may be output on a same physical pin, or two types of signals may be output by using two physical pins respectively. If the output is on the same physical pin, for each frame in a time-sharing mode, a frame synchronization signal is first output, and the row synchronization signals are output. In this embodiment, the optical control circuit first receives a frame synchronization signal sent by the display control circuit, and then delays T1 based on the received row synchronization signals.

For example, if delaying T1, because a time (for example, 8.3 μs in Embodiment 1 and Embodiment 2) for refreshing each row is known in advance, the delay duration T1 can be finally determined provided that the received row refreshing signals are counted and accumulated, that is, T1=[N*8.3 μs], where N is a quantity of accumulation times, and [ ] represents a rounding operation. In addition, a person skilled in the art may understand that, because T1 is not an accurate value, a value of N does not need to be accurate, and the person skilled in the art may perform some fine adjustments on the basis of this, to obtain a proper value of N.

Embodiment 4

Based on the foregoing embodiments, specific working duration of the optical control circuit is described in this embodiment. It may be understood that, in this application, when the application processor sends the working instruction to the optical control circuit to instruct the optical control circuit to work, a moment at which the optical control circuit receives the working instruction within a frame period is usually after a frame synchronization signal of the frame period. Therefore, in an implementation, the optical control circuit does not work in a frame corresponding to the moment at which the working instruction is received, but starts to work in a next frame, that is, after receiving a frame synchronization signal of the next frame, the optical control circuit starts to work (for example, to delay T1) as described in the foregoing embodiments. Simultaneously, the entire working procedure can be completed in one frame, or may be completed in one frame or two frames. The following describes these cases respectively.

Further, in this application, it is assumed that a $D^{th}$ row (that may also be understood as a distance between a placement position of the active optical component and the top of a mobile phone) is one row that is of one or more rows irradiated by light emitted by the active optical component and that is closest to pixels of a first row. Correspondingly, duration for refreshing the display screen from the first row to the $D^{th}$ row is T4. In this case, specific controlled delay duration T1 may be different based on different T4.

Case 1:

If T4 is greater than or equal to T2+T3, it indicates that the condition T1=T4−T2−T3 in the foregoing embodiments can be met (that is, a condition in which T1 is greater than or equal to 0 can finally be met). In this case, in a next frame, the optical control circuit can control the active optical component to work.

It may be understood that, in this case, a moment at which a pixel affected by illumination is refreshed is a moment in the next frame.

For example, as shown in FIG. 6 and FIG. 8, assuming that the optical control circuit receives a working instruction sent by the application processor in an $(N-1)^{th}$ frame (that is not shown in the figure), the optical control circuit completes work in an $N^{th}$ frame shown in the figure.

It should be noted that, in an extreme case, that is, when T4 is equal to T2+T3, T1 is equal to 0. In other words, the work is performed immediately after a frame synchronization signal is received.

Case 2:

If T4 is less than T2+T3, it indicates that the condition T1=T4−T2−T3 in the foregoing embodiments cannot be met (that is, T1 needs to be less than 0, which is impossible in practice). In this case, referring to FIG. 9, compared with that in Case 1, a delay time is longer than a time of one frame.

Figure 9:
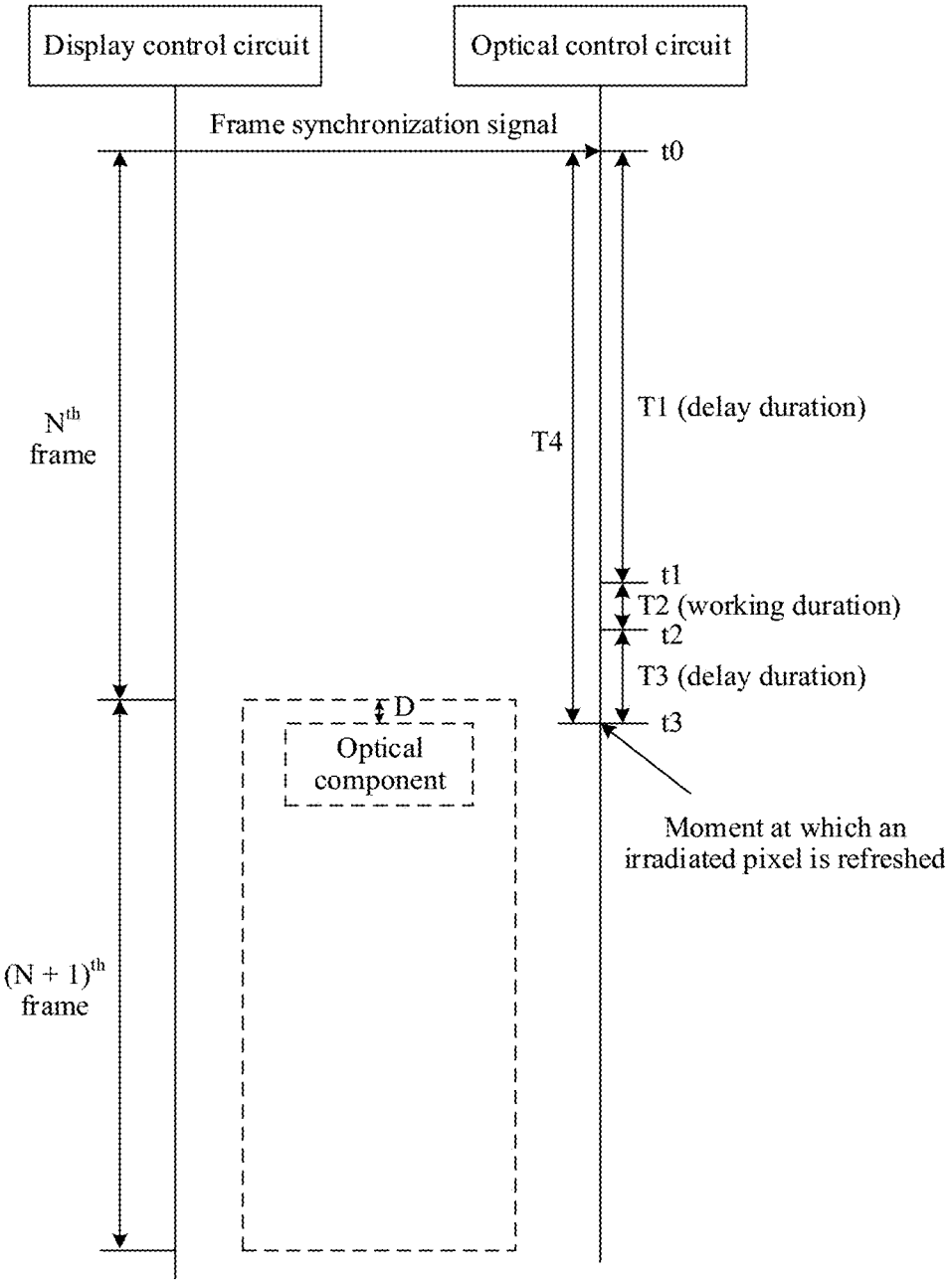
FIG. 9 is a schematic diagram of another working process of an electronic device according to this application.

Further, as shown in FIG. 9, assuming that the optical control circuit receives a working instruction sent by the application processor in an $(N-1)^{th}$ frame (that is not shown in the figure), the optical control circuit starts to delay T1 in an $N^{th}$ frame shown in the figure, and then works T2, and when an $(N+1)^{th}$ frame is refreshed after duration T3 is delayed, a location of a pixel that is on the display screen and that is irradiated by light emitted by the active optical component is refreshed. T1, T2, T3, and T4 still meet the conditions described in the foregoing embodiments.

In the foregoing two cases, when an optical component is disposed relatively close to the top of the mobile phone (in this case, D is relatively small) or far away from the top of the mobile phone (in this case, D is relatively large), this application provides corresponding solutions to implement this.

In another implementation, the active optical component may alternatively delay T1 each time the frame synchronization signal is received, and then determine whether a working instruction sent by the application is received within the delay duration T1. If yes, the active optical component works according to the foregoing procedure (for example, working T2 and delaying T3), otherwise, after receiving the frame synchronization signal within a next frame period, the active optical component delays T1 and determines whether the working instruction sent by the application is received. Accordingly, this is repeatedly performed.

Embodiment 5

Based on the foregoing embodiments, this embodiment describes working methods of the electronic device when the screen is off or when the screen is switched between an on state and an off state. It may be understood that, because the screen is off, pixels of the display screen do not emit light, so as to be not affected by illumination of the active optical component. Therefore, work may be performed based on a predetermined or existing working manner of the active optical component, that is, impact of a light spot does not need to be considered, and work can be performed based on predetermined requirements. For example, light emission is continuously performed in a specific period for a specific period of time. Alternatively, for example, work may be continuously performed within a plurality of frame periods, and it does not need to work within one frame period or one or two frame periods as in the foregoing embodiments.

It may be understood that, in an actual user application scenario, it cannot be ensured that work is performed in a screen-on or screen-off state. Therefore, there is a switching process. In this case, the active optical component may work in a screen-on or screen-off state based on an on or off state of the screen. For example, if the display screen is in a screen-on state, work may be performed by using the methods in the foregoing embodiments. In this application, one work period is from a moment at which the optical control circuit receives the synchronization signal (for example, a moment at which the one or more synchronization signals are received) to a moment at which the active optical component completes light emission. In this case, when the display screen is in a screen-on state, the optical controller may be further configured to control the active optical component to continue to work one or more work periods (for example, if a detection task cannot be completed in a specific work period, work may continue to be performed, that is, the work may repeatedly be performed in a plurality of work periods), alternatively, when the display screen is in a screen-off state, work may be performed in the predetermined or existing manner described in this embodiment.

A screen-off state may be determined by detecting whether there is a frame synchronization signal. That is, if the optical controller receives a frame synchronization signal, it indicates that the display screen is working and is in a screen-on state at this time, otherwise, it may be considered that the display screen is in a screen-off state and does not need to work. That is, in practice, the optical controller may directly determine a working manner based on whether a frame synchronization signal is received. Further, after determining to work (for example, after a working instruction sent by the application processor is received), the optical controller determines whether a frame synchronization signal is received, to determine a working manner. If a frame synchronization signal is received, the optical controller works in the manners in the foregoing embodiments when the display screen is on, otherwise, the optical controller works according to the method in this embodiment when the display screen is in a screen-off state.

For example, a telephone scenario is used as an example. When a telephone application is in an outgoing state, the application processor indicates the active optical component to start to work. In this case, if the active optical component (such as a proximity sensor) detects a frame synchronization signal (indicating that the screen is on), the active optical component works for a period of time in each frame. If detecting that a distance is less than a threshold, the active optical component indicates the application processor to turn off the screen. In this case, the optical controller cannot detect a frame synchronization signal (indicating that the screen is turned off), and the optical controller may work in a predetermined manner (for example, in a manner of continuously working). After a call is completed, the telephone application is in a hanging-up state, and the application processor indicates the active optical component to stop working.

Embodiment 6

Figure 10:
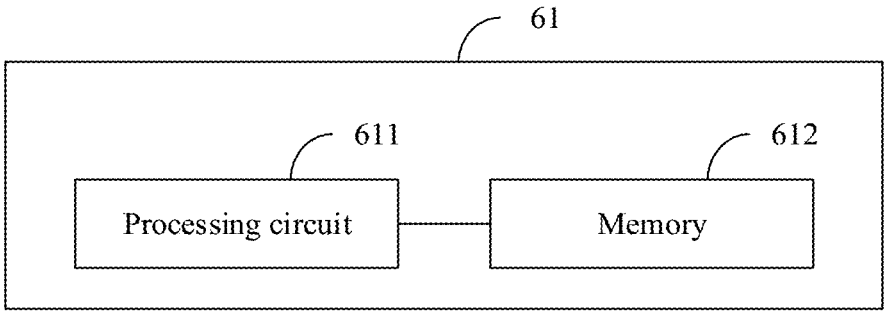
FIG. 10 is a schematic structural diagram of an optical control circuit according to this application.
Figure 11:
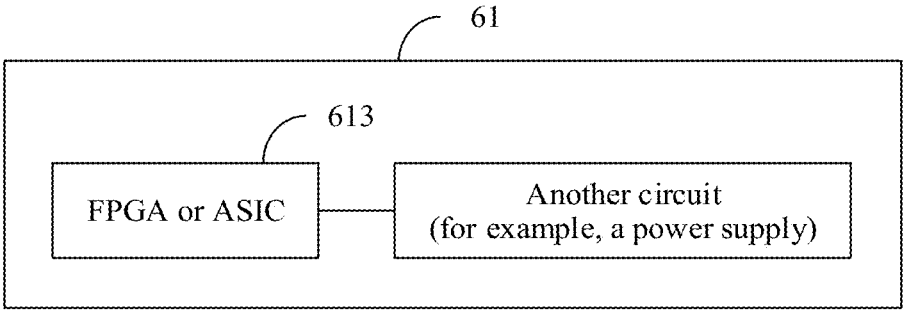
FIG. 11 is a schematic structural diagram of another optical control circuit according to this application.

Based on the foregoing embodiments, as shown in FIG. 10, this application discloses an optical control circuit 61. The optical control circuit is the optical control circuit in the foregoing embodiments, and is configured with various functions of the optical control circuit in the foregoing embodiments. The optical control circuit may include a processing circuit and a memory. The processing circuit 611 is configured to read code stored in the memory 612, and execute the read code, to implement functions to be implemented by the optical control circuit in the foregoing embodiments. Alternatively, as shown in FIG. 11, the optical control circuit 61 may be implemented based on a hardware circuit such as an ASIC or FPGA 613 (and may further include another circuit). The hardware circuit may include various sub-circuits inside to implement functions of the optical control circuit in this application. Details are not described in this application again.

The optical control circuit may be individually packaged into a chip, or may be packaged together with another circuit to form a chip. For example, the optical control circuit may be the sensor hub chip in which a plurality of control circuits is integrated in the foregoing embodiment.

Figure 12:
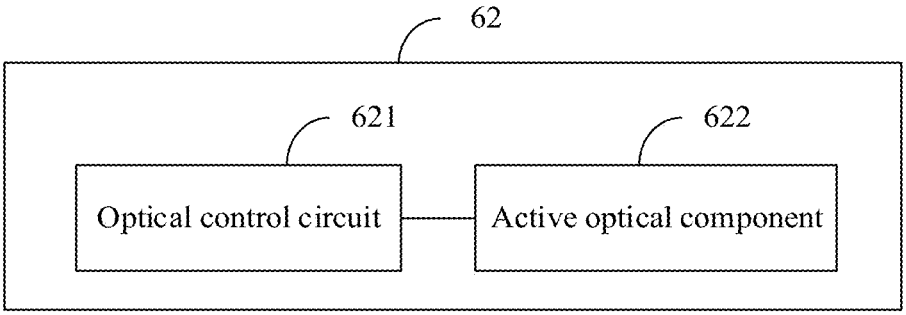
FIG. 12 is a schematic structural diagram of an optical module according to this application.

As shown in FIG. 12, this application further discloses an optical module 62, including an optical control circuit 621 and an active optical component 622. The optical control circuit 621 may be the optical control circuit in the foregoing embodiments.

A person of ordinary skill in the art may understand that all or a part of the procedure of the methods in the foregoing embodiments may be implemented by a computer program instructing related hardware. The program may be stored in a computer-readable storage medium. When the program runs, the procedures of the methods in the embodiments are performed. The storage medium may be a magnetic disk, an optical disc, a ROM, a RAM, or the like.

In the foregoing exemplary embodiments, the objective, the technical solutions, and the advantages of this application are further described in detail. It should be understood that the foregoing descriptions are merely exemplary embodiments of this application, but are not intended to limit this application. Any modification, equivalent replacement, or improvement made without departing from the spirit and principle of this application should fall within the protection scope of this application.

What is claimed is:

1. An electronic device, comprising:

a display screen comprising at least one row of pixels;

an optical control circuit;

an active optical component located below the display screen, coupled to the optical control circuit, and corresponding to a first row of the at least one row; and a display control circuit coupled to the display screen and the optical control circuit and configured to:

refresh the display screen; and output a synchronization signal to the optical control circuit, wherein the optical control circuit is configured to:

receive the synchronization signal; and control the active optical component to start light emission after a first delay that is after a first moment corresponding to the synchronization signal, wherein the active optical component is configured to complete the light emission, and wherein the display control circuit is further configured to refresh to the first row after a second delay that is after the active optical component completes the light emission.

2. The electronic device of claim 1, wherein the second delay is greater than or equal to a duration (Tmin) and is less than a sensitivity (Tmax) of human eyes to recognize an object, and wherein Tmin is for restoring a pixel of the display screen to a normal electrical characteristic after the pixel is irradiated by light emitted by the active optical component.

3. The electronic device of claim 1, wherein the synchronization signal comprises a frame synchronization signal, and wherein the optical control circuit is further configured to:

receive the frame synchronization signal; and control, in response to receiving the frame synchronization signal, the active optical component to start the light emission and complete work after the first delay.

4. The electronic device of claim 1, wherein the synchronization signal comprises a frame synchronization signal, and wherein the optical control circuit is further configured to:

receive row synchronization signals from the display control circuit;

receive the frame synchronization signal; and start, in response to receiving the frame synchronization signal, to count a quantity of subsequently received row synchronization signals to control the active optical component to perform the first delay and to start the light emission and complete work after the first delay.

5. The electronic device of claim 1, wherein the optical control circuit is further configured to control the active optical component to continuously work at a first power for a duration after the active optical component starts the light emission.

6. The electronic device of claim 1, wherein a first duration is equal to a sum of the first delay, the second delay, and a second duration from a second moment when the active optical component starts the light emission to a third moment when the active optical component completes the light emission, and wherein the first duration is either less than a frame period or is greater than the frame period and less than two frame periods.

7. The electronic device of claim 1, wherein a work period is from a second moment when the optical control circuit receives the synchronization signal to a third moment when the active optical component completes the light emission, and wherein the optical control circuit is further configured to control the active optical component to continue working for one or more work periods when the display screen is in a screen-on state.

8. The electronic device of claim 1, wherein the display screen is an organic light-emitting diode (LED) (OLED) display screen or a micro LED display screen.

9. An optical control circuit for an electronic device, wherein the optical control circuit comprises:

a memory configured to store code; and a processing circuit coupled to the memory and configured to execute the code to cause the optical control circuit to:

receive a synchronization signal from a display control circuit of the electronic device; and control an active optical component of the electronic device to start light emission after a first delay that is after a first moment corresponding to the synchronization signal to enable the display control circuit to refresh to a first row of at least one row of pixels on a display screen of the electronic device corresponding to the active optical component after a second delay that is after the active optical component completes the light emission, wherein the second delay is greater than or equal to a duration (Tmin) and is less than a sensitivity (Tmax) of human eyes to recognize an object, and wherein Tmin is for restoring a pixel of the display screen to a normal electrical characteristic after the pixel is irradiated by a light emitted by the active optical component.

10. The optical control circuit of claim 9, wherein the synchronization signal comprises a frame synchronization signal, and wherein the processing circuit is further configured to execute the code to cause the optical control circuit to:

receive the frame synchronization signal; and control, in response to receiving the frame synchronization signal, the active optical component to start the light emission and complete work after the first delay.

11. The optical control circuit of claim 9, wherein the synchronization signal comprises a frame synchronization signal, and wherein the processing circuit is further configured to execute the code to cause the optical control circuit to:

receive row synchronization signals from the display control circuit;

receive the frame synchronization signal; and start, in response to receiving the frame synchronization signal, to count a quantity of subsequently received row synchronization signals to control the active optical component to perform the first delay and to start the light emission and complete work after the first delay.

12. The optical control circuit of claim 9, wherein the processing circuit is further configured to execute the code to cause the optical control circuit to control the active optical component to continuously work at a first power for a duration after the active optical component starts the light emission.

13. The optical control circuit of claim 9, wherein a first duration is equal to a sum of the first delay, the second delay, and a second duration from a second moment when the active optical component starts the light emission to a third moment when the active optical component completes the light emission, and wherein the first duration is either less than a frame period or is greater than the frame period and less than two frame periods.

14. The optical control circuit of claim 9, wherein a work period is from a second moment when the optical control circuit receives the synchronization signal to a third moment when the active optical component completes the light emission, and wherein the processing circuit is further configured to execute the code to cause the optical control circuit to control the active optical component to continue working for one or more work periods when the display screen is in a screen-on state.

15. The optical control circuit of claim 9, wherein the display screen is an organic light-emitting diode (LED) (OLED) display screen or a micro LED display screen.

16. An active optical component control method implemented by an optical control circuit in an electronic device, wherein the active optical component control method comprises:

receiving a synchronization signal from a display control circuit of the electronic device, wherein the electronic device further comprises a display screen comprising at least one row of pixels and an active optical component located below the display screen; and controlling the active optical component to start light emission after a first delay that is after a moment corresponding to the synchronization signal to enable the display control circuit to refresh to a first row of at least one row of pixels on the display screen corresponding to the active optical component after a second delay that is after the active optical component completes the light emission.

17. The active optical component control method of claim 16, wherein the second delay is greater than or equal to a duration (Tmin) and is less than a sensitivity (Tmax) of human eyes to recognize an object, and wherein Tmin is for restoring a pixel of the display screen to a normal electrical characteristic after the pixel is irradiated by a light emitted by the active optical component.

18. The active optical component control method of claim 16, wherein the synchronization signal comprises a frame synchronization signal, and wherein the active optical component control method further comprises:

receiving the frame synchronization signal; and controlling, in response to receiving the frame synchronization signal, the active optical component to start the light emission and complete work after the first delay.

19. The active optical component control method of claim 16, wherein the synchronization signal comprises a frame synchronization signal, and wherein the active optical component control method further comprises:

receiving the frame synchronization signal;

receiving row synchronization signals from the display control circuit; and starting, in response to receiving the frame synchronization signal, to count a quantity of subsequently received row synchronization signals to control the active optical component to perform the first delay and to start the light emission and complete work after the first delay.

20. The active optical component control method of claim 16, further comprising controlling the active optical component to continuously work at a first power for a duration after the active optical component starts the light emission.

* * * * *